US006019174A

United States Patent [19]

Korsgaard

[11] Patent Number: 6,019,174

[45] Date of Patent: Feb. 1, 2000

[54] METHOD AND APPARATUS FOR PRODUCING AND SHIPPING HYDROCARBONS OFFSHORE

[76] Inventor: Jens Korsgaard, 318 N. Post Rd., Princeton Junction, N.J. 08550

[21] Appl. No.: 08/814,147

[22] Filed: Mar. 10, 1997

Related U.S. Application Data

[63] Continuation-in-part of application No. 08/784,871, Jan. 16, 1997.

[51] Int. Cl.[7] ..... E21B 43/01

[52] U.S. Cl. ..... 166/352; 166/357

[58] Field of Search ..... 166/352, 357; 114/74 A; 220/592

[56] References Cited

U.S. PATENT DOCUMENTS

| | | | |
|---|---|---|---|
| 2,381,396 | 8/1945 | Kuhn . | |
| 3,145,680 | 8/1964 | Farkas et al. . | |
| 3,311,063 | 3/1967 | Grable . | |
| 3,556,218 | 1/1971 | Talley, Jr. et al. . | |
| 3,590,407 | 7/1971 | Bratianu et al. | 166/352 |
| 3,602,302 | 8/1971 | Kluth | 166/352 |
| 3,705,626 | 12/1972 | Glenn, Jr. et al. | 166/267 |
| 4,083,318 | 4/1978 | Verolme . | |
| 4,113,132 | 9/1978 | Steiner . | |
| 4,243,528 | 1/1981 | Hubbard et al. | 166/75.12 |
| 4,301,840 | 11/1981 | Jansen | 141/98 |
| 4,310,263 | 1/1982 | Daughtry | 166/341 |
| 4,375,835 | 3/1983 | Archer | 166/339 |
| 4,446,804 | 5/1984 | Kristiansen et al. . | |
| 4,448,568 | 5/1984 | Gentry et al. . | |
| 5,199,266 | 4/1993 | Johansen . | |
| 5,256,171 | 10/1993 | Payne | 95/19 |
| 5,477,924 | 12/1995 | Pollack | 166/357 |
| 5,697,732 | 12/1997 | Sigmundstad . | |

*Primary Examiner*—Hoang Dang
*Attorney, Agent, or Firm*—Kenyon & Kenyon

[57] ABSTRACT

A method and apparatus for off-shore production of oil. Special shuttle tankers with high-pressure cargo tanks capable of containing the produced live crude oil at a pressure close to that of the ambient pressure inside a subterranean oil field, and without any processing of the live crude oil prior to transportation are used. The produced live crude oil from the subterranean oil field is pumped directly into the high-pressure cargo tanks aboard the shuttle tanker. Lighter fractions of the live crude oil stored in the shuttle tanker may be used as a fuel to power the propulsion machinery and the auxiliary machinery aboard the shuttle tanker. The pressures in the tanks are ordinarily above 70 kPa gauge pressure, may be higher than 1.8 MPa gauge, and may range as high as 35 MPa gauge or even higher. The tanker vessel transports the produced live crude oil to an onshore processing plant for separation into gas, water, solids, and stabilized crude oil.

47 Claims, 5 Drawing Sheets

METHOD AND APPARATUS FOR PRODUCING AND SHIPPING HYDROCARBONS OFFSHORE

This application is a continuation-in-part of U.S. patent application Ser. No. 08/784,871, filed Jan. 16, 1997.

BACKGROUND OF THE INVENTION

1. Field of the Invention

The present invention relates to a method and apparatus for producing and shipping hydrocarbons, e.g., crude oil, from an offshore site. In particular, the present invention relates to a method and apparatus which does not require an offshore processing plant and which allows both gas and oil to be shipped to an onshore processing plant.

2. Description of the Prior Art

Crude oil and natural gas from offshore wells is produced in the following manner according to the teachings of the presently-known prior art technology. First, the crude oil and gas wells are drilled and completed using drilling equipment that is mounted on either a jack-up drilling rig or on a floating vessel.

After the wells have been drilled and completed they are typically connected to an offshore processing plant that separates the live crude oil from the well—which is typically a mixture of oil, gas, water, salt and other solids—into a stabilized crude oil with a low vapor pressure—that is therefore suitable for transportation in ordinary tanker vessels—and a natural gas component—that is suitable for transportation onshore by a pipeline ordinarily, the stabilized crude oil is processed at the offshore processing plant sufficiently so that it may be used in a standard onshore refining process without further treatment to remove solids, salt, and water from the crude oil. Therefore, the offshore processing facility also removes water, salt and other solids from the live crude oil before it is transferred to the vessel as stabilized crude oil.

The stabilized crude oil may then be transported ashore by pipeline or by tanker vessels, which tanker vessels normally store the stabilized crude oil at or near atmospheric pressure. The produced gas is ordinarily transported ashore in pipelines. In addition to transporting the produced gas ashore by pipeline, a number of emerging technologies exist to transport the gas in ships, by subjecting the gas to chemical processes that convert it, for example, into methanol or by liquefying the gas and transporting it as a cooled liquid. The technologies for transporting the gas in ships all require large capital expenditures and cause the loss of a significant fraction of the energy content in the gas during processing and transportation.

If tanker transportation of the stabilized crude oil is used from the offshore oil field processing plant, significant hydrocarbon losses usually occur due to de-gassing of the crude oil in the cargo tanks. The economics and safety of ordinary tanker transportation do not permit the re-capture and retention of this gas, leading to the waste of this energy source.

In the event that no pipeline is available to transport the gas ashore, because of, e.g., distance, many jurisdictions today require that the gas be re-injected into the hydrocarbon-bearing soil formation to preserve the gas for future production when the economics of exploitation permits the production and transportation of the gas. At locations where re-injection requirements do not exist, the gas may be burned in a flare. Either of these processes, re-injection or flaring, are expensive and waste energy that could otherwise be produced or used.

The offshore processing plant of the presently-known prior art technology may be mounted on a platform sitting on the sea bed, on a ship-like vessel, on a semi-submersible, or on a tension leg platform. Other possible means of mounting offshore processing plants also exist. However, all of these means have in common the fact that the platform for supporting the processing plant is very expensive.

The offshore processing plant of the presently-known prior art technology is expensive compared to a comparable crude oil processing plant on land, because the offshore processing plant must be specially adapted for the offshore environment, for operation in a restricted space, to compensate for possible movement and accelerations of the plant during operations, and for limited possibilities for maintenance. Furthermore, the crew operating the offshore plant is regularly ferried back and forth between the platform and land, and all their needs, with the possible exception of fuel, must also be ferried to the plant from shore.

Thus, the capital costs and the operating costs for an offshore processing plant of the presently-known technology is much higher than for a corresponding plant on land.

Some of the problems of the above-described method are addressed in U.S. Pat. No. 4,446,804. In this patent, a method is described for loading shuttle ships with live crude oil directly from subsea oil wells. This process consists of loading the live crude oil into tanks on the shuttle tanker that are pre-filled with a displacement liquid and pressurized to a pressure near the pressure of the live crude oil to be received. The live crude oil then displaces the displacement liquid under nearly constant pressure during the loading operation. This procedure results in a shuttle tanker having an extraordinary complex cargo handling system with a large number of valves and instruments. Another disadvantage of the system described in U.S. Pat. No. 4,446,804 is that the tanker must be designed for a pressure near the bubble point of the crude oil, to take full advantage of the shuttle tanker loading system.

The system described in U.S. Pat. No. 4,446,804, however, has the advantage of minimizing the release of gas from the crude oil by maintaining the cargo always near maximum pressure. A severe drawback to the system described in U.S. Pat. No. 4,446,804 is that the containment system in the tanker must be designed for the bubble pressure of the received crude oil. This pressure varies from oil field to oil field. Therefore a tanker may be designed to serve a specific oil field, which limits its utility, or may be designed to be used in a number of oil fields. In the latter case the cargo containment system must be designed for a highest pressure in the oil fields, possibly as high as 35 MPa. Another relevant patent to this field is U.S. Pat. No. 5,199,266. This patent describes a method for transporting gas from offshore fields, which gas has been produced on offshore production platforms by pressurizing the gas and cooling it to a temperature in the range of −100° C. to −120° C. In this temperature range and at a pressure of approximately 1.5 MPa, all hydrocarbon gases normally occurring in oil wells are liquid. As described in U.S. Pat. No. 5,199,266 the gas must be delivered to the transport vessel in gaseous form and is then cooled and liquefied on the shuttle vessel. A very large and expensive cooling plant is required on the gas transport vessel to cool and condense the gas to be transported. Thus, the system described in U.S. Pat. No. 5,199,266 not only requires an offshore production platform in accordance with the traditional technology but also require a number of high pressure, refrigerated tanker vessels each fitted with a large-capacity cooling plant.

SUMMARY OF THE INVENTION

The object of the present invention is to overcome some or all of the drawbacks associated with the present technologies. This object is achieved by constructing special shuttle tankers with high-pressure cargo tanks capable of containing the produced live crude oil (i.e., crude oil which has not been stabilized by removal of mixed gas, or further processed to remove water, salt or other solids) at a pressure close to that of the ambient pressure inside the subterranean oil field, and without any processing of the live crude oil prior to transportation. The produced live crude oil from the subterranean oil field is pumped into high-pressure cargo tanks aboard the shuttle tanker, either directly or through a flash drum. Re-injection or flaring of produced gas mixed with the crude oil is avoided or greatly reduced, and escape of the lighter fractions of the crude oil to the atmosphere is prevented.

In the ordinary application of the invention, the produced oil will separate into two phases, a gas phase and an oil phase that has a lower gas-oil ratio (GOR) than the produced crude oil. As the pressure in the receiving tanks rise the gas phase becomes proportionally smaller compared to the oil phase. If the bubble point of the produced oil is sufficiently low, the gas phase may become zero when the pressure in the tanks have risen sufficiently. Re-injection or flaring of produced gas is avoided or greatly reduced and escape of the lighter fractions of the crude oil to the atmosphere is prevented.

The volumetric ratio between gas and oil may vary between zero and one. Thus a vessel according to the present invention is universal and may produce crude oil from offshore oil fields having all GORs from zero (i.e., no gas in the produced fluids) to the produced fluids being 100 percent gas.

In the practice of the present invention, it is the intent to use the lighter fractions, such as methane, of the produced live crude oil stored in the shuttle tanker as a fuel to power the propulsion machinery and the auxiliary machinery aboard the shuttle tanker. This action lowers the pressure of the contained live crude oil. The ambient temperature of the live crude oil in the ground is ordinarily significantly higher than the ambient temperature at the sea surface. During the production process the produced live crude oil is cooled, as the result of transfer of the live crude oil from the well, through the riser and into the vessel, with a consequent reduction in vapor pressure of the live crude oil.

The pressures at which the cargo must be contained in order to contain most of the lighter fractions of the produced live crude oil in liquid form vary greatly from oil field to oil field. However, the pressures would ordinarily be above 70 kPa gauge pressure, may be higher than 1.8 MPa gauge, and may range as high as 35 MPa gauge or even higher. Standard shuttle tankers of the prior art can only accept a pressure differential of approximately 25 kPa between the interior of the cargo tanks and the exterior atmosphere, i.e., a pressure of 25 kPa gauge. Therefore, tanks in ordinary tankers of the prior art must be vented to the atmosphere to prevent dangerous differential pressures from building within the cargo tank as gas dissociates from the stabilized crude oil because of the vapor pressure increase as the result of storing the stabilized crude oil at or near atmospheric. This venting in the prior art causes significant energy loss, which loss is eliminated or greatly reduced using the method and apparatus of the present invention.

A particular advantage of the present invention is that the live crude oil is produced into tanks aboard the shuttle tanker that have an internal pressure close to atmospheric at the start of the loading process. This crude oil dissociates into liquid and gas phases in the tanks. As more crude oil enters the cargo tanks the dissociated gas is compressed and raises the pressure in the tanks. Normally the cargo tank design pressure is reached before the cargo tanks are full. Therefore, a shuttle tanker having a particular design pressure may be applied to wide variety of oil fields with different crude oils, regardless of the bubble pressure. The only difference is the degree to which the tanker can be filled without venting the gas.

When the crude oil having a high GOR is discharged into a vessel with much lower pressure, the flow expands violently and may cause high wear of the piping, fittings, valves, and the receiving tank itself. The produced crude oil often contains sand and other grit increasing the erosion of the system. For this reason the tankers in this invention will usually be fitted with a flash drum that is maintained at the pressure of the receiving cargo tank. This flash drum is the pressure vessel that receives and reduces the pressure of the crude oil. The flash drum may be located at an easily-accessible location on the tanker so that it can be replaced whenever the wear of its components warrant its replacement.

To be able to efficiently handle crude oils with a high GOR the present invention also allows the venting of the gas in the cargo tanks of the shuttle vessel into refrigerated cargo tanks that are cooled by an onboard refrigeration plant. By this method, all hydrocarbons normally occurring in crude oil except methane will condense and become liquid, and the methane itself can be stored at a higher density because of its lower temperature.

The discharging of crude oil and gas at the processing plant is particularly easy in the present invention. The crude oil is drawn from the bottom of the cargo tanks using the high pressure in the tanks to provide energy to pump the oil ashore. If the vessel is fitted with cooled storage tanks natural gas liquids are drawn from the bottom of these tanks, and pumped ashore by the high pressure in these tanks. The natural gas remaining is only partly discharged so that a sufficient quantity remains to be used as fuel for propulsion on the tanker's return trip to the oil field.

Application of the present invention requires that the tanker vessel transport the produced live crude oil to an onshore processing plant for separation into gas, water, solids, and stabilized crude oil. This plant may be situated anywhere that the tanker vessel can go that is advantageously situated relative to customers of the oil and the gas.

The above and other features and advantages of the oil production method and apparatus are described in detail below in connection with the drawings.

DETAILED DESCRIPTION OF THE INVENTION

Figure 1:
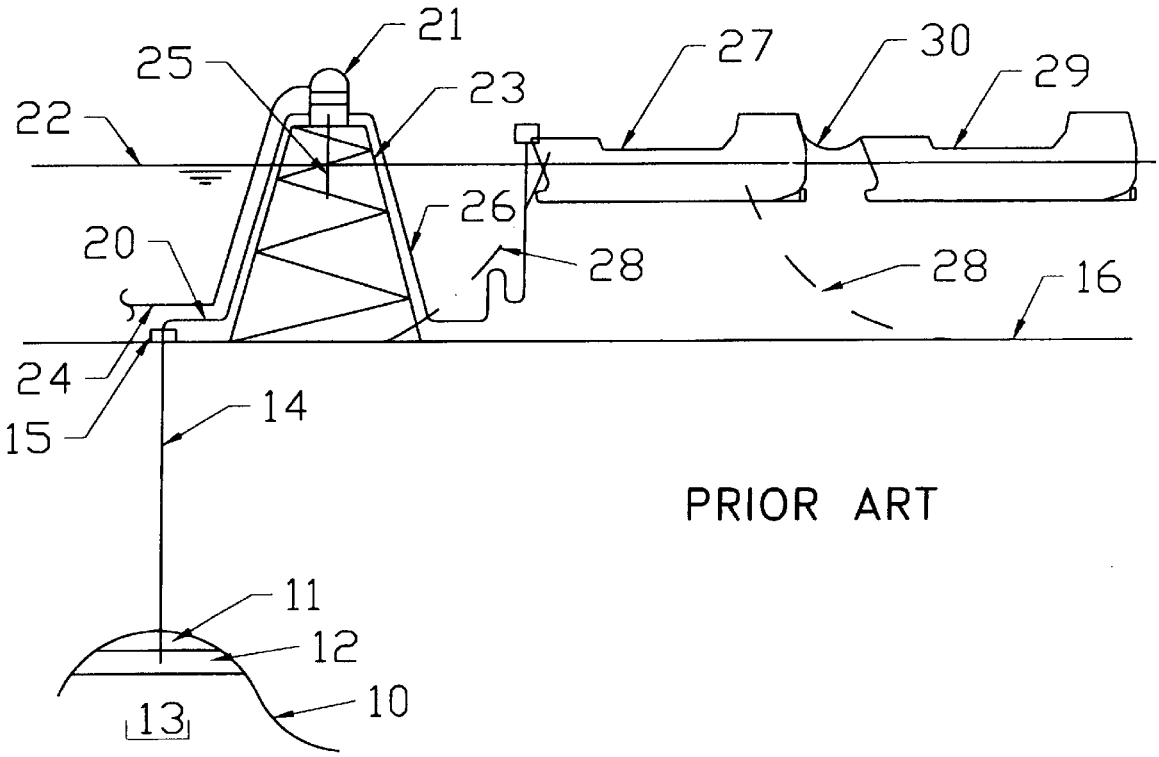
FIG. 1 is diagram representing the existing technology of offshore oil production.

FIG. 1 illustrates an example of the production of oil in accordance with the present, prior art, technology.

An underground sub-sea hydrocarbon reservoir 10 may include a gas layer 11, an oil layer 12, and a water layer 13. The reservoir 10 is tapped though a well 14. The well 14 terminates in a wellhead 15 at the sea bed 16. A crude oil/water/gas mixture (which mixture may also contain salt and other solids), also known as live crude oil, flows from the well head 15 through the pipe 20 to a processing plant 21 elevated above the sea surface 22 by a platform 23. The processing plant 21 separates the live crude oil into a gas that is conveyed to shore by the pipeline 24, produced water that is discharged to the sea through pipe 25, and stabilized crude oil that is transferred through a pipe 26 to a floating storage vessel 27. Stabilized crude oil is crude oil which has had, inter alia, volatile gas removed from it by the processing plant 21.

The storage vessel 27 is permanently moored near the platform 23 by anchor lines 28 connected to sea bed anchors (not shown), and stores the stabilized crude oil produced by the processing plant 21 at approximately atmospheric pressure or at a pressure no greater than 25 kPa gauge. The crude oil is transported away from the storage tanker 27 by shuttle tankers 29 that receive the oil through a cargo transfer hose 30. Shuttle tankers 29 also store the stabilized crude oil at approximately atmospheric pressure or at a pressure no greater than 25 kPa gauge.

Figure 2:
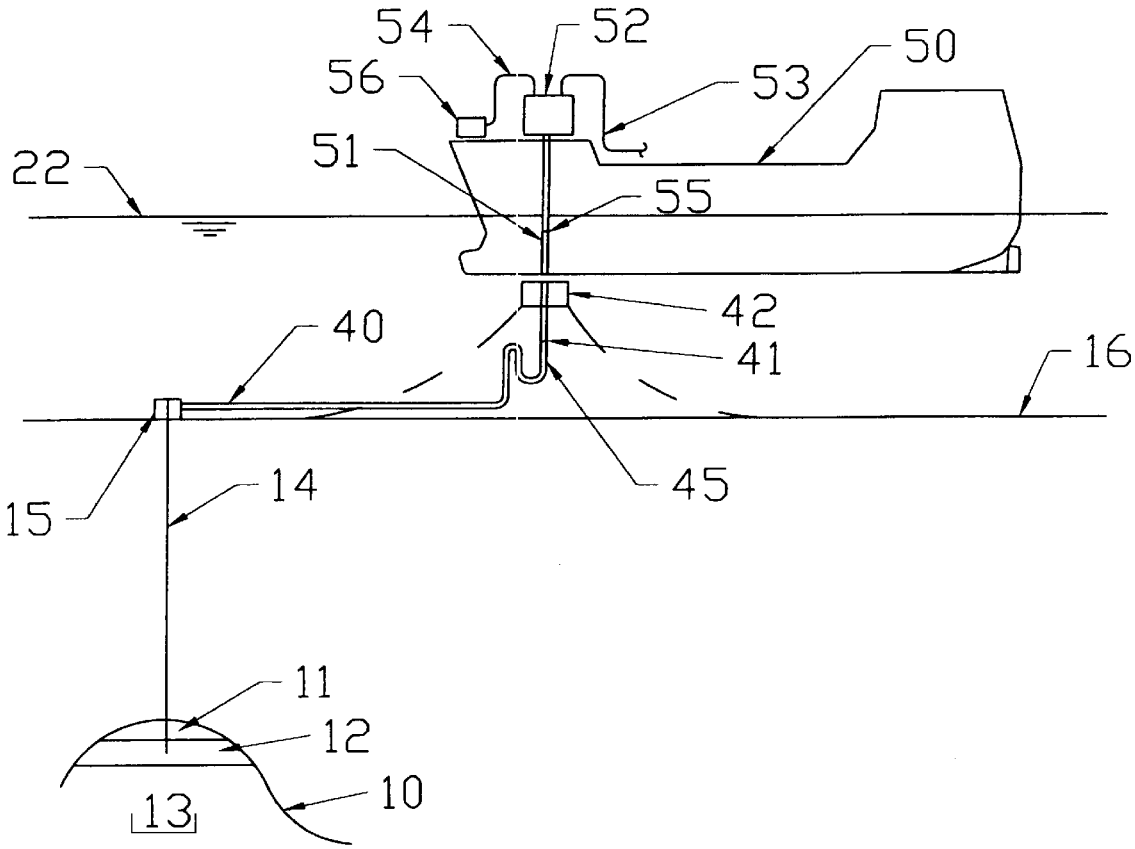
FIG. 2 is a diagram describing offshore oil production in accordance with the present invention.

FIG. 2 shows an oil production system in accordance with the teachings of the present invention. A sub-sea hydrocarbon reservoir 10 comprises a gas layer 11, an oil layer 12, and a water layer 13. The reservoir 10 is tapped by the well 14 terminating in a sub-sea wellhead 15. The wellhead 15 may be located at the sea-bed 16 or above or below the seabed 16 as circumstances may dictate. The wellhead 15 is connected through a pipeline 40 to a riser 41 terminating in a mooring buoy 42 for the shuttle tanker 50. Mooring buoy 42 may be of the type shown in my U.S. Pat. Nos. 5,305,703; 5,339,760; 5,380,229; 5,553,976; 5,447,114 and 5,515,803; and my U.S. Pat. Nos. 5,647,295 and 5,676,083. The live crude oil is conveyed through the mooring buoy 42 by piping (not shown) in the mooring buoy 42 to piping 51 in the shuttle tanker 50, through a multi-path swivel 52, and to cargo piping 53 aboard the tanker 50. The tanker 50 is a special tanker adapted to store the produced crude oil at a pressure at or somewhat below the pressure in the sub-sea oil field 10.

The well head 15 may include instrumentation and controls (not shown) in order to monitor the flow from the well and in order to be able to shut in the well. The instrumentation and the controls (not shown) at the well head 15 are connected to the vessel 50 by an umbilical 45 connected to control and instrument cabling 55 aboard the vessel 50. The cabling 55 is connected through the multipath swivel 52 to fixed cabling 54 to control and monitoring systems 56 aboard the vessel 50.

The riser 40, submarine pipeline 41, and umbilical 45 may consist of multiple individual units connecting to a number of different wellheads 15. Each of the risers 40 and umbilicals 45 may connect to multiple pipes 53 and multiple cabling 54 aboard the vessel. The multi-path swivel 52 in such a case would be equipped with sufficient fluid, instrument, and control paths (not shown) to service all risers 41 and umbilicals 45 individually. The umbilical 45 may also contain electrical or hydraulic power conduits (not shown) to power subsea pumping equipment (not shown) to boost the flow in the well 14.

Some of the wells 14 may serve as water injection wells 91 or as gas injection wells 93 (see FIG. 3) being supplied with water and gas, respectively, from the vessel 50. While it is usually advantageous to avoid gas injection wells 93 when producing the crude oil using the technology taught in the present invention, all standard well production and stimulation schemes may be employed, provided the vessel 50 is fitted with the required equipment.

Figure 3:
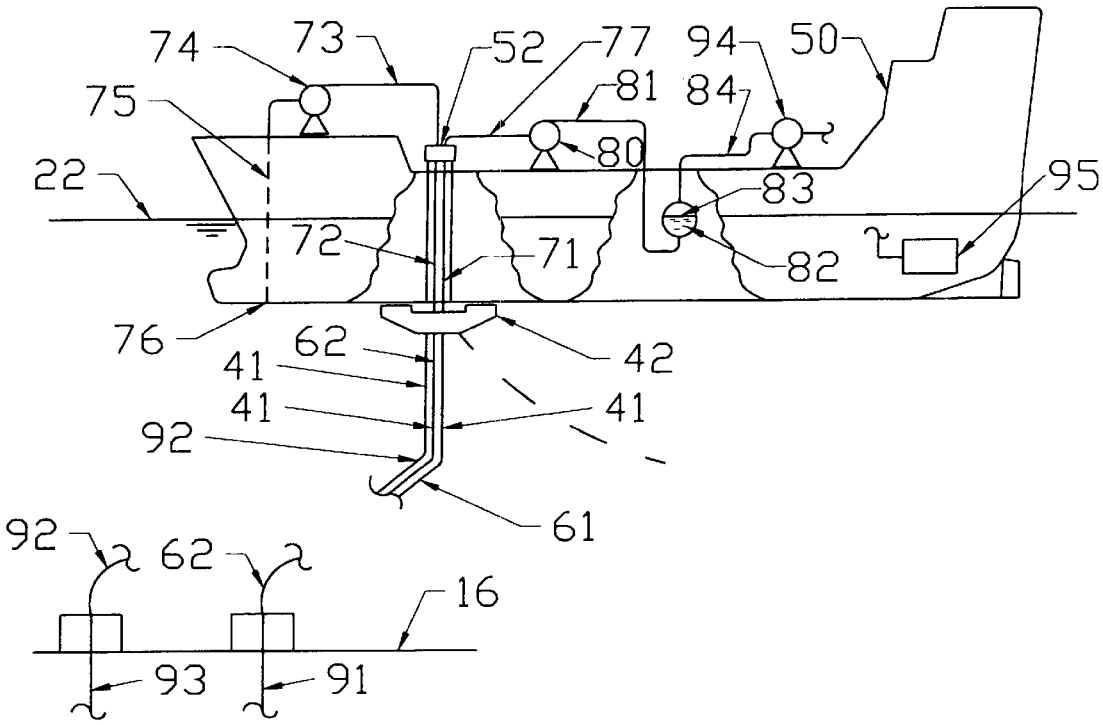
FIG. 3 is side view of a vessel adapted for the production of offshore oil in accordance with the present invention.

FIG. 3 shows in more detail the vessel 50. In this figure the control, power, and instrumentation equipment 56, 54, 55, and 45 have been omitted for clarity.

Three risers 41 are shown, one 61 is connected to an oil producing well (not shown), one 62 is connected to a water injection well 91, and one 92 is connected to a gas injection well 93. It is to be understood that water injection well 91, water injection riser 62, gas injection well 93 and gas injection riser 92 are all optional features, and are only needed where local geological conditions or local regulations require that water or gas be re-injected into reservoir 10. Water for water injection is drawn from the sea at intake 76 and conveyed to the pump 74 through suction piping 75. The pump 74 has a discharge pressure sufficient to overcome the flow pressure losses in the well and the pressure in the oil field itself. The water is conveyed through the discharge pipe 73, through the multi-path fluid swivel 52, and into connector pipe 72. The connector pipe 72 is connected to internal piping (not shown) in mooring buoy 42 and then to the riser 62, and thereafter into the water injection well 91.

The produced crude-oil/water/gas mixture or live crude oil is received through riser 61 then through piping in the mooring buoy 42 (not shown) to connector pipe 71. The produced fluids are then conveyed through the multi-path swivel 52 to suction pipe 77 for pump 80. Pump 80 raises the pressure in the produced fluid sufficient so that the dissociation of gases in the crude oil stops or slows down significantly. The produced fluid is then conveyed through pipe 81 to the high pressure storage tank 82. Storage tank 82 is normally spherical or cylindrical. The vessel is usually equipped with a large number of tanks 82, but only one is shown in FIG. 3, for clarity. The produced fluid stored in tanks 82 will typically dissociate into a gas phase and fluid phase, separated by a surface 83 within the tank 82. The gas phase may be drawn off through the pipe 84 for use as fuel for powering the propulsion system 95 of tanker 50 or for other purposes aboard the tanker 50. As an alternative, the gas phase may also be drawn off, pressurized by a gas pump 94, conveyed by piping (not shown) to the multi-path fluid swivel 52, into a connector pipe (not shown) connected to internal piping (not shown) in mooring buoy 42, then conveyed to a gas injection riser 92 connected to the internal piping in the mooring buoy 42, and thereafter into a gas injection well 93.

Storage tanks 82, in order to limit the dissociation of gases in the crude oil and to safely handle and transport the crude-oil/water/gas mixture, must be designed to maintain the crude-oil/water/gas mixture at a pressure approximating that in the formation 10. The storage tanks 82 must therefore be capable of holding pressures of above 70 kPa gauge pressure, pressures which may be in excess of 1.8 MPa gauge, and pressures possibly as high as 35 MPa gauge. One tank design which will hold pressures in this range and which will also comply with maritime and other safety regulations is disclosed in Provisional Patent Application Ser. No. 035,579, filed Jan. 16, 1997.

In the event that produced water settles out in tank 82 it may be withdrawn through piping (not shown) and conveyed to pump 74 for re-injection into the formation 10, through water injection riser 62 and water injection well 91.

Operation of the device of the present invention is as follows. First, one or more crude oil and gas wells 14 are drilled and completed using drilling equipment that is mounted on either a jack-up drilling rig or on a floating vessel (not shown). Thereafter, each drilled well is capped with a suitable wellhead 15. Wellheads 15 may include or be connected to subsea pumping equipment (not shown) which boosts the flow in the well, instrumentation and control equipment (not shown) which monitors the flow from the well and may shut off the flow from the well. Riser 40, which may contain one or more risers 41 and umbilicals 45, is then connected to the wellheads 15, which riser 40 is then connected to a mooring buoy 42, which mooring buoy 42 is anchored to the sea bed in a known fashion.

When it is desired to retrieve and transport live crude oil from the wells 14, vessel 50 steered over the mooring buoy 42 and thereafter attached to the mooring buoy in a known manner. Cabling 54 and piping 53 on the vessel is connected to the umbilicals 45 and risers 41 by connection of piping 51 and cabling 55, connected to the swivel connection 52 on the vessel 50, with piping and cabling (not shown) in the mooring buoy 42, connected to risers 41 and umbilicals 45. Control and monitoring systems 56 on vessel 50 are then activated to send a signal, through cabling 54 and umbilicals 45, to open the flow of fluids from the wells 14 and/or to pump fluids from the wells 14. The live crude oil flowing from wells 14 flows through risers 61, through mooring buoy 42, through connector pipe 71 and suction pipe 77. The live crude oil is thereafter pressurized by pump 80 so that it flows into tanks 82, through pipe 81, and is thereafter stored in tanks 82 at a pressure approximately equal to that at which the live crude oil was kept in the reservoir 10, i.e., pressures of above 70 kPa gauge, pressures which may be in excess of 1.8 MPa gauge, and pressures possibly as high as 35 MPa gauge. During the time when the vessel 50 is connected to mooring buoy 42, seawater may be pumped by pump 74 through intake 76, discharge pipe 73, riser 62 and into water injection well 91, if local conditions or regulations require water re-injection into the reservoir 10. Additionally, or alternatively, water which settles out in tanks 82 may be pumped by pump 74 into water injection well 91. Additionally, if local conditions or regulations require gas re-injection into the reservoir 10, gas in tanks 82 may be pumped by pump 94 through pipe 84, through riser 92 and into gas injection well 93.

After the tanks 82 on vessel 50 have been filled with live crude oil, the control and monitoring systems 56 on vessel 50 are then activated to send a signal, through cabling 54 and umbilicals 45, to shut off the flow of fluids from the wells 14 and/or to discontinue pumping of fluids from the wells 14. Cabling 54 and piping 53 on the vessel are disconnected to the umbilicals 45 and risers 41 by disconnection of piping 51 and cabling 55 with piping and cabling (not shown) in the mooring buoy 42. Vessel 50 thereafter is unattached from the mooring buoy 42 in a known manner. Vessel 50 then sails to a suitable onshore processing plant (not shown), where the vessel 50 is moored and the live crude oil in tanks 82 is transferred to the processing plant for subsequent processing. During sailing of vessel 50, gas from tanks 82 may be conveyed through pipe 84 to powered equipment, including the propulsion system, on vessel 50, to be used as a source of power for that equipment.

Figure 4:
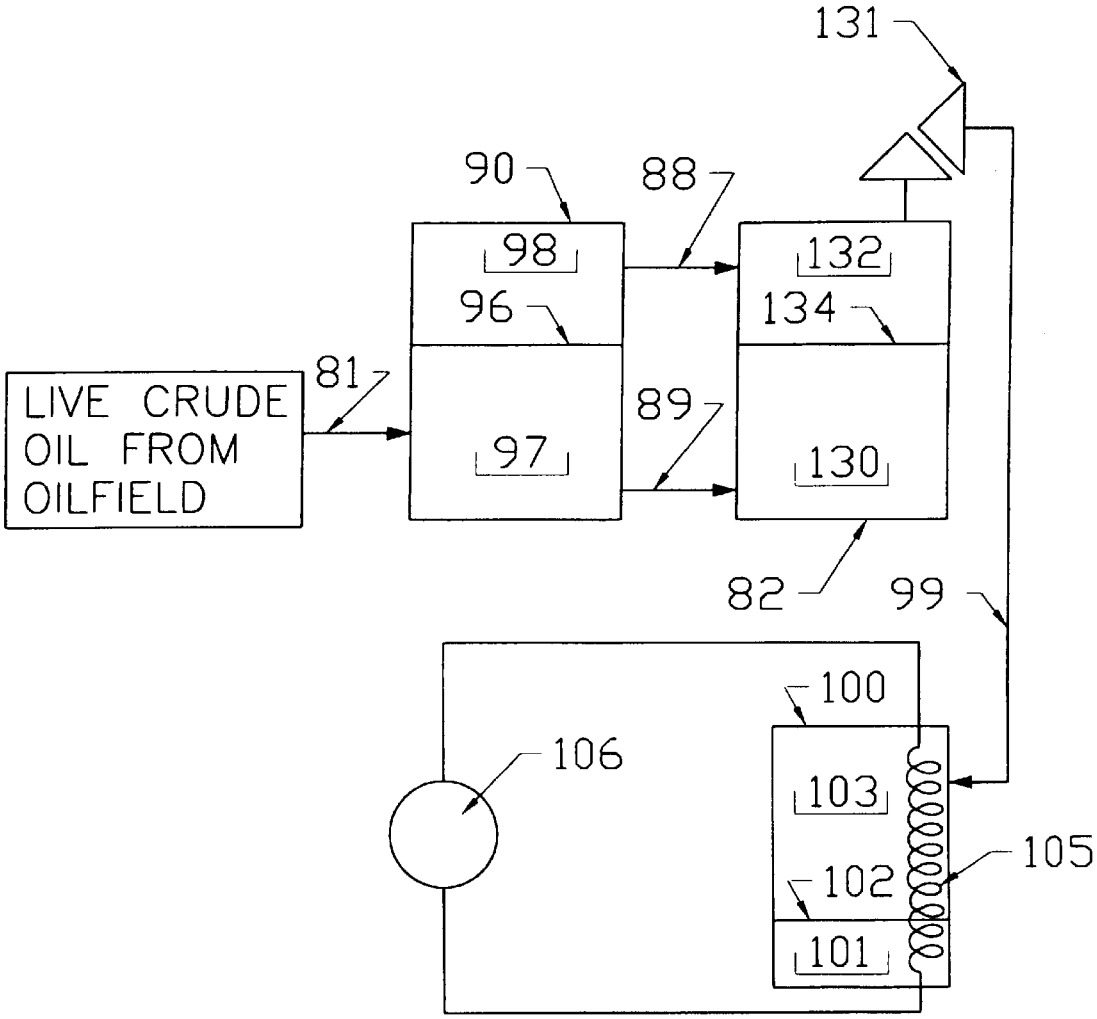
FIG. 4 is a diagram showing the processes aboard a shuttle tanker according to one embodiment of the present invention, adapted for cooling produced gasses.

FIG. 4 shows in diagram of a modified embodiment of the present invention, for the receipt and storage of live crude oil. Live crude oil is received on the vessel 50 at the flash tank 90 through pipe 81. In the flash tank 90 the live crude oil separates into a gas phase 93 and a liquid phase 94, which are separated by the liquid surface 91. The gas phase 93 is conveyed through pipe 88 to the storage tank 82. The liquid phase is conveyed through pipe 89 to the storage tank 82. In the storage tank 82, the liquid occupies the bottom part 95 and the gas the top part 96, separated by the liquid surface 94.

The continued production of oil keeps raising the level 94 and thereby raising the pressure in the tank 82. At some point the set pressure of relief valve 96 is reached and the gas phase 93 vents through pipe 97 to gas tank 100. Tank 100 is cooled by a coil 105 powered by a refrigeration machine 106. The crude oil liquid phase 95 would typically be maintained at temperatures ranging from 5° C. to 60° C., depending on the characteristics of the crude oil. Tank 100 would typically be maintained at a temperature of −20° C. to 10° C. Normally the pressure in tanks 82 and 100 would exceed 5 MPa, and thus all hydrocarbons but methane would condense into liquid form in tank 100. The liquids 101 collect at the bottom of tank 100 separated from the gas 103 by liquid surface 102.

Figure 5:
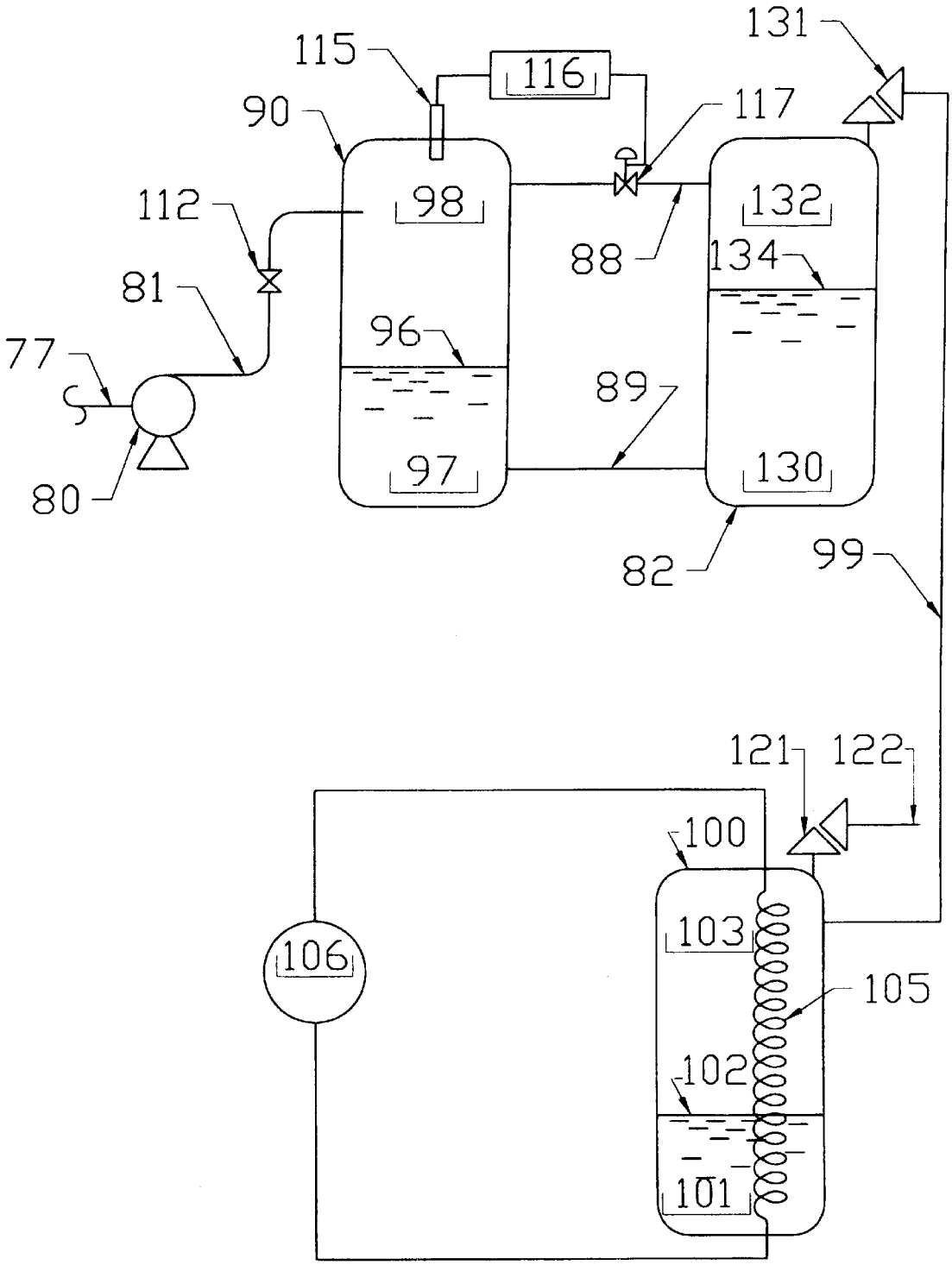
FIG. 5 is a diagram showing the flash drum receiving the crude oil in tankers according to the embodiment of FIG. 4.

FIG. 5 depicts the system in FIG. 4 in more detail. Pipe 77 aboard the tanker receives the crude oil and feeds it to pump 80 that raises the pressure of the fluid. For some oil wells, pump 80 may be necessary to increase the drive force on the crude oil from the well. For other wells having a high drive pressure, pump 80 may be omitted or bypassed. The crude oil is conveyed through pipe 81 through metering valve 112, from which it flashes into flash tank 90. Flash tank 90 is preferably located at a low elevation near the bottom of the vessel 50. The storage tanks 82 are generally located at a higher elevation than tank 90. The flash drum 90 is fitted with a liquid level sensor 115 sensing the location of the liquid gas interface 91. The signal from sensor 115 is sent to a processing unit 116 that controls valve 117. Valve 117 is opened whenever the level 91 falls below a preset level and closed when the level 91 rises above a preset level. By this action the crude oil is forced by the gas pressure in tank 90 into storage tank 82 through pipe 89. The gas 93 that flashes out of the crude oil in flash drum 90 is metered in the proper amount into tank 82 to maintain a nearly constant liquid level in tank 90.

As the liquid level 94 rises in tank 82, the pressure increases as well. At some point the gas 93 is vented through relief valve 96 to the gas storage tank 100. The gas storage tank 100 functions in a similar manner to the oil storage tank 82, with the exception that it is cooled by heat exchanger 105, cooled by refrigeration machine 106. As the liquid level increases in tank 100 the set pressure of relief valve 121 will be reached. The pressure in tank 100 is then kept constant by venting the gas through pipe 122 which may for example vent to a flare (not shown) or to the power plant or propulsion equipment for the vessel 50. The system will reach its maximum storage capacity when either the liquid level 94 or the liquid level 102 reaches the top of the tank 82 and 100 respectively.

Typically the vessel will be fitted with numerous storage tanks 82 and 100. The vessel may also be fitted with more than one flare drum 90. In this event the vessel will be fitted with piping and valving (not shown) that permits the sequential loading of tanks 82 and 100.

However, in an alternative embodiment, the valve 117 may be closed continuously or the pipe 88 may be eliminated. In this embodiment, the liquid surface 91 would at all times be at the bottom of flash drum 90. Pipe 89 would, in this embodiment, convey a mixture of gas and liquid. The gas would in this embodiment bubble up through the liquid 95 in tank 82. In all other respects, the operation of this embodiment is identical to the embodiment described above.

While the invention has been described in the specification and illustrated in the drawings with reference to preferred embodiments, it will be understood by those skilled in the art that various changes may be made and equivalents may be substituted for elements of the invention without departing from the scope of the claims.

What is claimed is:

1. An oil production system for off-shore use comprising:

an oil well, the oil well producing produced fluids;

a riser connected to the oil well; and a floating vessel, the floating vessel including at least one high-pressure storage tank, the high-pressure storage tank being designed to store the produced fluids at a pressure between 200 kPa gauge pressure and 35 MPa gauge pressure, the vessel further including at least one flash drum, the at least one flash drum being selectively coupled to the riser, the at least one flash drum being coupled to the at least one storage tank by at least one line.

2. The system of claim 1, further comprising:

a pump, the pump being connected to the oil well, the increasing the pressure of the produced fluids.

3. The system of claim 1, wherein:

the at least one line includes a first gas line and a liquid line.

4. The system of claim 3, further comprising:

a second gas line, the second gas line drawing off gas from the at least one storage tank.

5. The system of claim 4, further comprising:

a relief valve in the second gas line, the relief valve opening at a set gas pressure.

6. The system of claim 4, wherein:

the vessel includes powered equipment, and wherein the second gas line is connected to the powered equipment, gas from the produced fluids powering the powered equipment.

7. The system of claim 6, wherein:

the powered equipment is a propulsion system.

8. The system of claim 1, further comprising:

a mooring buoy, the riser being connected to the mooring buoy, the mooring buoy selectively coupling the flash drum to the riser.

9. The system of claim 4, further comprising:

at least one gas storage tank, the at least one gas storage tank being connected to the second gas line.

10. The system of claim 9, wherein:

the at least one gas storage tank includes a heat exchanger.

11. The system of claim 10, further comprising:

a refrigeration unit, the refrigeration unit being connected to the heat exchanger, the heat exchanger cooling gas in the at least one gas storage tank.

12. The system of claim 9, further comprising:

a vent line connected to the at least one gas storage tank, the vent line venting gas from the at least one gas storage tank.

13. The system of claim 12, further comprising:

a relief valve in the vent line, the relief valve opening at a set gas pressure.

14. The system of claim 1, further comprising:

a liquid level sensor in the at least one flash drum, the liquid level sensor sensing a liquid level in the at least one flash drum.

15. The system of claim 14, further comprising:

a control valve in the at least one line, the control valve being connected to the liquid level sensor, the control valve controlling the flow of gas in the at least one line, thereby controlling the liquid level in the at least one flash drum.

16. A method for producing crude oil offshore, comprising:

producing the crude oil from an oil well;

transferring the crude oil into at least one flash drum on a vessel; and transferring gas and liquid from the at least one flash drum to at least one storage tank through at least one line;

storing the gas and liquid in the at least one storage tank at a pressure between 200 kPa gauge pressure and 35 MPa gauge pressure.

17. The method of claim 16, further comprising:

pumping the crude oil from the well into the at least one flash drum.

18. The method of claim 16, further comprising:

transporting the crude oil in the vessel.

19. The method of claim 16, further comprising:

drawing off gas from the at least one storage tank.

20. The method of claim 19, further comprising:

using gas drawn off from the at least one storage tank to propel the vessel.

21. The method of claim 19, further comprising:

transferring the gas drawn off from the at least one storage tank to at least one gas storage tank.

22. The method of claim 21, further comprising:

cooling gas transferred to the at least one gas storage tank.

23. The method of claim 21, further comprising:

venting gas from the at least one gas storage tank.

24. The method of claim 16, further comprising:

sensing a level of liquid in the at least one flash drum; and controlling the transfer of gas from the at least one flash drum to thereby control the level of liquid in the at least one flash drum.

25. The method of claim 16, further comprising:

transferring gas from the at least one flash drum to the at least one storage tank on the vessel through a first gas line, and transferring liquid from the at least one flash drum to the at least one storage tank on the vessel through a liquid line.

26. The method of claim 19, further comprising:

disconnecting the vessel from the oil well; and using gas drawn off from the at least one storage tank to propel the vessel after the vessel is disconnected from the oil well.

27. An oil production system for off-shore use comprising:

an oil well, the oil well producing produced fluids;

a riser connected to the oil well;

a floating vessel, the floating vessel including at least one storage tank, the vessel further including at least one flash drum, the at least one flash drum being selectively coupled to the riser, the at least one flash drum being coupled to the at least one storage tank by at least one line, the at least one line conveying both liquid and gas components of the produced fluids to the at least one storage tank;

a gas line connected to the at least one storage tank, the gas line drawing off gas from the at least one storage tank; and powered equipment on the vessel, the gas line being connected to the powered equipment, gas from the produced fluids powering the powered equipment.

28. The system of claim 27, further comprising:

a pump, the pump being connected to the oil well, the pump increasing the pressure of the produced fluids.

29. The system of claim 27, wherein:

the at least one line includes a second gas line and a liquid line.

30. The system of claim 27, wherein:

the powered equipment is a propulsion system.

31. The system of claim 27, further comprising:

a mooring buoy, the riser being connected to the mooring buoy, the mooring buoy selectively coupling the flash drum to the riser.

32. The system of claim 27, further comprising:

at least one gas storage tank, the at least one gas storage tank being connected to the gas line.

33. The system of claim 32, wherein:

the at least one gas storage tank includes a heat exchanger.

34. The system of claim 33, further comprising:

a refrigeration unit, the refrigeration unit being connected to the heat exchanger, the heat exchanger cooling gas in the at least one gas storage tank.

35. The system of claim 32, further comprising:

a vent line connected to the at least one gas storage tank, the vent line venting gas from the at least one gas storage tank.

36. The system of claim 35, further comprising:

a relief valve in the vent line, the relief valve opening at a set gas pressure.

37. The system of claim 27, further comprising:

a liquid level sensor in the at least one flash drum, the liquid level sensor sensing a liquid level in the at least one flash drum.

38. A method for producing crude oil offshore, comprising:

producing the crude oil from an oil well;

transferring the crude oil into at least one flash drum on a vessel; and transferring gas and liquid from the at least one flash drum to at least one storage tank through at least one line;

drawing off gas from the at least one storage tank; and using gas drawn off from the at least one storage tank to propel the vessel.

39. The method of claim 38, further comprising:

pumping the crude oil from the well into the at least one flash drum.

40. The method of claim 38, further comprising:

transporting the crude oil in the vessel.

41. The method of claim 38, further comprising:

using gas drawn off from the at least one storage tank to propel the vessel.

42. The method of claim 38, further comprising:

transferring the gas drawn off from the at least one storage tank to at least one gas storage tank.

43. The method of claim 42, further comprising:

cooling gas transferred to the at least one gas storage tank.

44. The method of claim 42, further comprising:

venting gas from the at least one gas storage tank.

45. The method of claim 38, further comprising:

sensing a level of liquid in the at least one flash drum; and controlling the transfer of gas from the at least one flash drum to thereby control the level of liquid in the at least one flash drum.

46. The method of claim 38, further comprising:

transferring gas from the at least one flash drum to the at least one storage tank on the vessel through a first gas line, and transferring liquid from the at least one flash drum to the at least one storage tank on the vessel through a liquid line.

47. The method of claim 41, further comprising:

disconnecting the vessel from the oil well; and using gas drawn off from the at least one storage tank to propel the vessel after the vessel is disconnected from the oil well.

* * * * *